US005125239A

United States Patent [19]

Kobayashi et al.

[11] Patent Number: 5,125,239

[45] Date of Patent: Jun. 30, 1992

[54] SELF-CONTAINED AIR CONDITIONER

[75] Inventors: Tatsuhiro Kobayashi, Otsu; Hideki Matsumi, Shiga, both of Japan

[73] Assignee: Matsushita Electric Industrial Co., Ltd., Osaka, Japan

[21] Appl. No.: 646,566

[22] Filed: Jan. 28, 1991

[30] Foreign Application Priority Data

Jan. 31, 1990 [JP] Japan ..... 2-23167

[51] Int. Cl.[5] ..... F25D 21/14

[52] U.S. Cl. ..... 62/262; 62/291; 55/467

[58] Field of Search ..... 62/262, 263, 285, 288, 62/291; 98/94.2; 220/669; 55/126, 467

[56] References Cited

U.S. PATENT DOCUMENTS 2,081,107 5/1937 Kilb et al. ..... 62/262 X
2,813,406 11/1957 Smith ..... 62/285
3,035,422 5/1962 Halbeisen ..... 62/262 X
3,306,071 2/1967 Holyfield ..... 62/288 X
3,320,872 5/1967 Wegman ..... 62/262 X
3,477,211 11/1969 Pietsch ..... 62/262 X
3,584,468 6/1971 Crise ..... 62/262

*Primary Examiner*—William E. Tapolcai
*Attorney, Agent, or Firm*—Panitch, Schwarze, Jacobs & Nadel

[57] ABSTRACT

A self-contained air conditioner which includes a moisture-collecting pan formed of a part of the base plate on which a compressor, an inner heat exchanger and an outer heat exchanger are mounted and an air filter disposed between an inner grill and the inner heat exchanger, wherein the bottom of the air filter is set to be placed on the pan, thus preventing moisture formed on the air filter from dropping through the inner grill onto the floor of the room.

4 Claims, 5 Drawing Sheets

SELF-CONTAINED AIR CONDITIONER

BACKGROUND OF THE INVENTION

1. Field of the Invention

The present invention relates to a self-contained air conditioner adapted for installment to a vertically sliding window.

2. Description of the Prior Art

The conventional self-contained air conditioner of the above-mentioned type has a structure as shown in FIG. 1. The self-contained air conditioner has a body 51 which comprises a grill 52 toward a room (hereinafter called "inner grill"), a grill 53 toward the outside (hereinafter called "outer grill"), and an inner unit 54 incorporated removably in the outer grill 53. The inner unit 54 accommodates a base 55 made of a metal plate and a partition 58 which is mounted on the base 55 and divides an outer air path 56 and an inner air path 57. The outer air path 56 comprises an outer heat exchanger 59, a propeller fan 60, a motor 61, a motor base 62, an air guider 63 and a compressor constituting a known freezing cycle (not shown). The inner air path 57 comprises an inner heat exchanger 64, a moisture-collecting pan 65, a sirocco fan 66 and a sirocco fan air guider 67. The inner grill 52 is installed to the outer grill 53 by engaging claws formed on the positions A of the inner grill 52 to notches formed on the positions B of the outer grill 53. An air filter 68 is slid into the inner grill 52 by means of a separately deposited rail (not shown).

Under the structure described above, however, since the air filter 68 is installed in the inner grill 52, moisture formed on the air filter 68 flows down along the air filter 68 to the bottom of the inner grill 52 and finally drops onto the floor of the room. Moreover, an elastic mechanism is provided only on the air filter 68, failing in giving a feeling of complete fitting of the air filter. Thus, a better structure for installing the air filter in the inner grill to overcome these problems has been required.

Furthermore, the inner grill 52 is installed to the outer grill 53 only by engaging the claws (A) on the top side of the grill 52 to the notches (B) of the outer grill 53. The claws are not strong enough to firmly support the inner grill 52 and the installing condition of the inner grill 52 varies depending on the precision of the metal plate forming the outer grill 53, causing difficult or incorrect installation of the inner grill 52 to the outer grill 53.

SUMMARY OF THE INVENTION

The self-contained air conditioner of the present invention, which overcomes the above-discussed and numerous other disadvantages and deficiencies of the prior art, comprises a moisture-collecting pan formed on a base on which a compressor, an inner heat exchanger and an outer heat exchanger are mounted and an air filter disposed between an inner grill and said inner heat exchanger, wherein the bottom of said air filter is set to be placed on said moisture-collecting pan.

In a preferred embodiment, grill reinforcing ribs are provided on the back face of the inner grill to guide the elastic air filter In a preferred embodiment, said base and said outer grill are formed by integrated resin molding, while a metal partition dividing the inner and outer portions is fixed on said base, and ribs are formed on a fitting portion of the inner grill, which is also formed by resin molding, so as to firmly mount the inner grill to said partition.

In a preferred embodiment, the tip end of each rib formed on the inner grill is slanted so as to smoothly guide the inner grill to the partition when the inner grill is mounted to the partition. This arrangement ensures improvement of the installation.

Thus, the invention described herein makes possible the objectives of (1) providing a self-contained air conditioner which prevents moisture on a filter from falling onto the inner grill, (2) providing a self-contained air conditioner capable of minimizing vibration resulting from the operation of the air compressor, thereby reducing noise arising from the vibration, (3) providing a self-contained air conditioner capable of easy installation in position on the back side of the inner grill, and (4) providing a self-contained air conditioner which has a reinforced grill.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Figure 1:
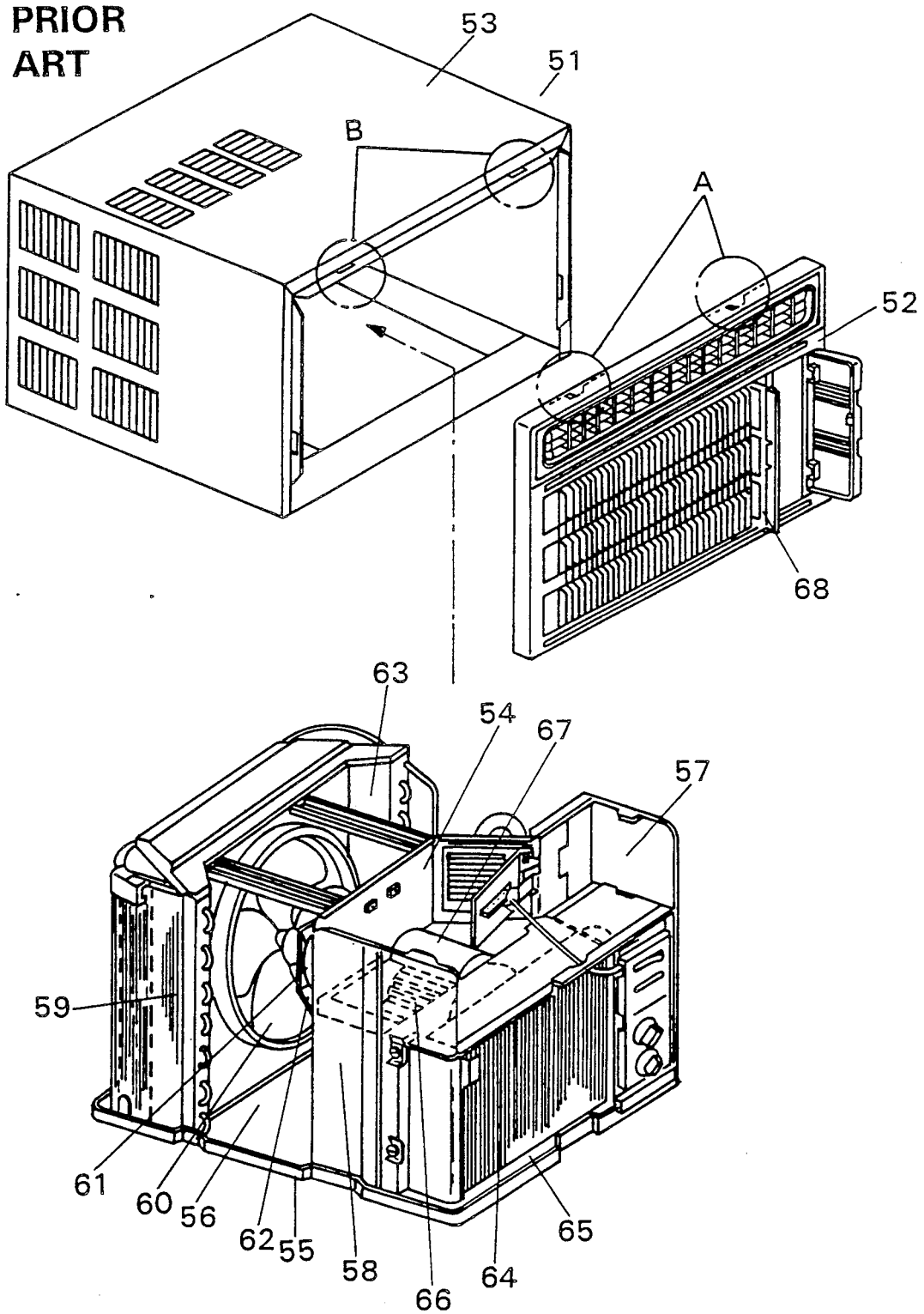
Fig. 1 PRIOR ART
FIG. 1 is an exploded perspective view of a known self-contained air conditioner.
Figure 2A:
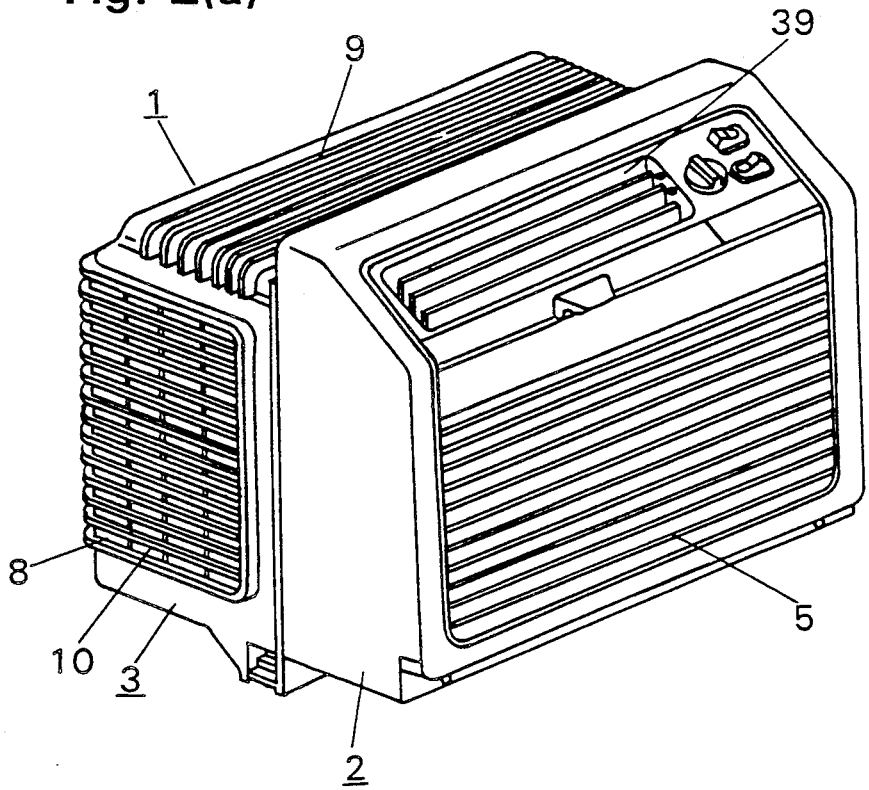
FIGS. 2(*a*), 2(*b*) are surface views of a self-contained air conditioner according to the present invention.
Figure 2B:
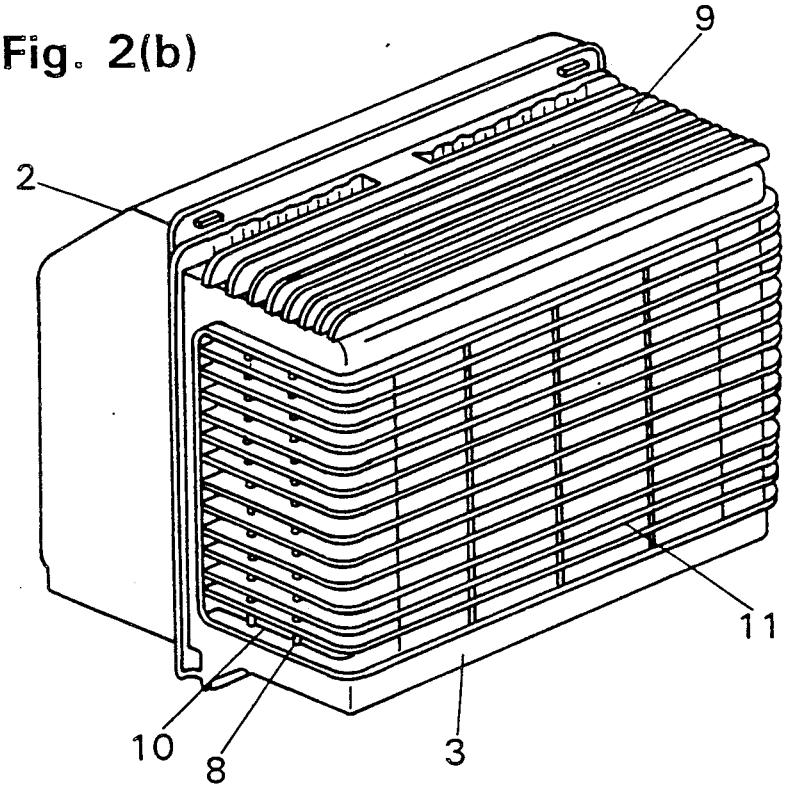
Figure 3:
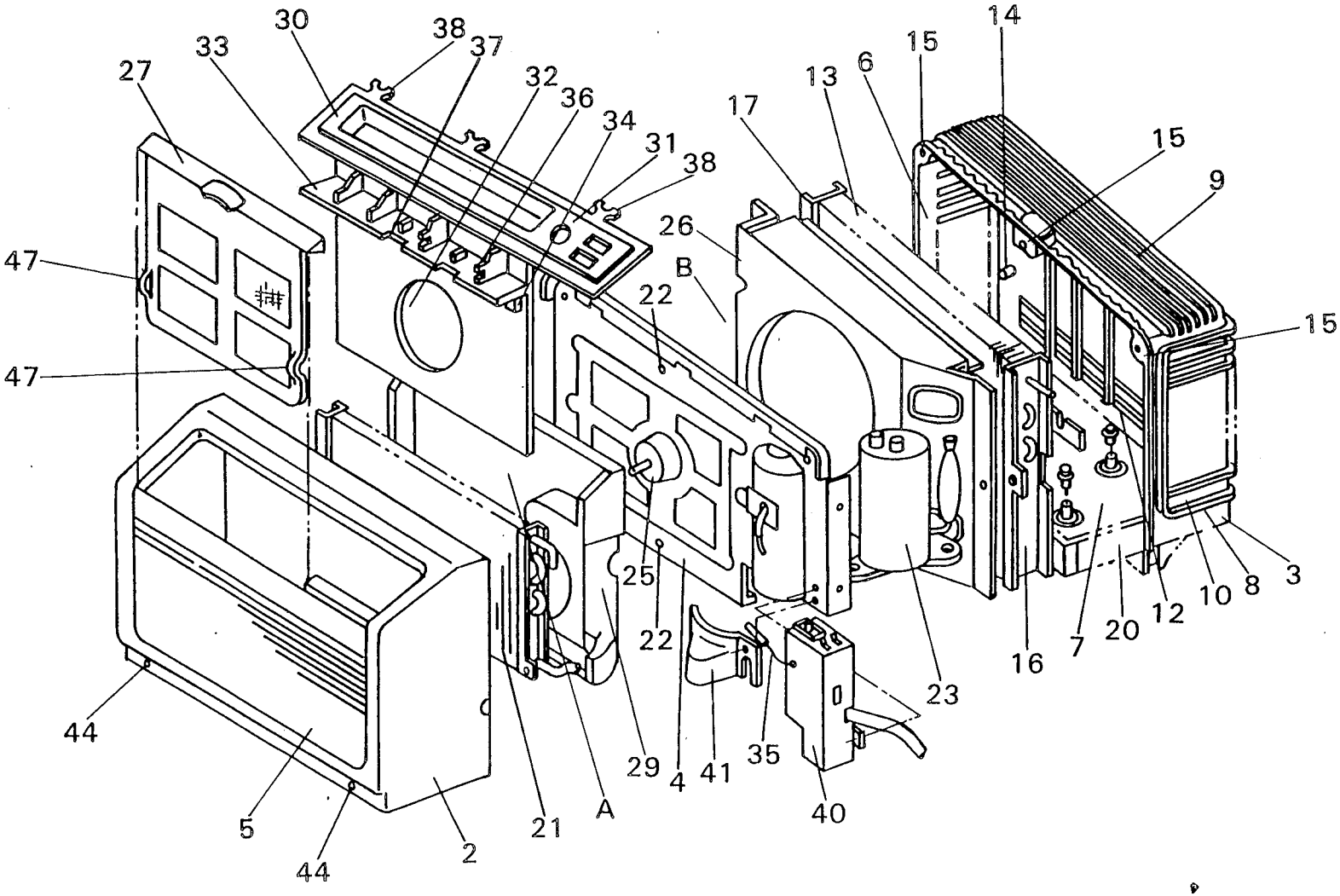
FIG. 3 is an exploded perspective view of the self-contained air conditioner of FIG. 2.
Figure 4A:
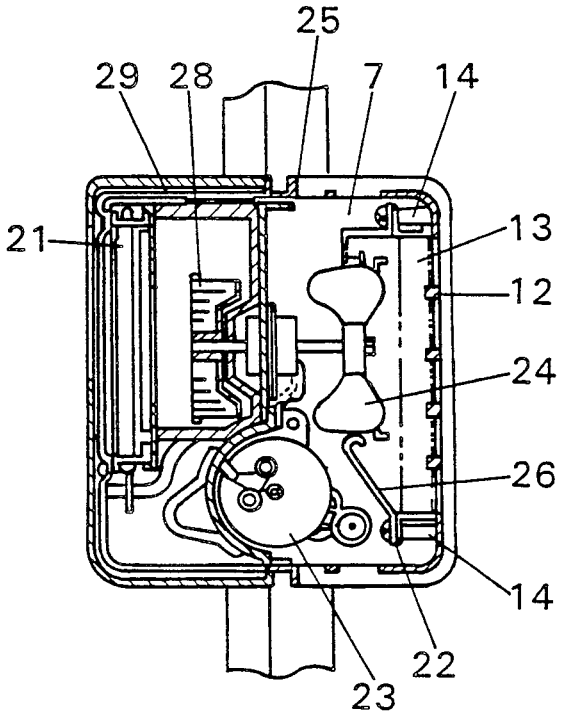
FIGS. 4(*a*), 4(*b*) are sectional views of the self-contained air conditioner of FIG. 2.
Figure 4B:
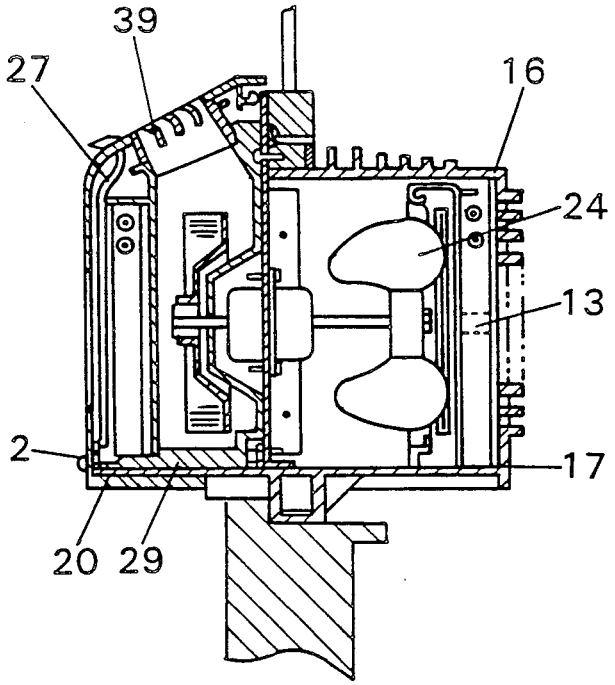

First, the whole structure of an embodiment of the self-contained air conditioner according to the present invention is described. Referring to FIGS. 2 to 4. The reference numberal 1 is a body of the self-contained air conditioner comprising an inner grill 2, a frame 3, a partition 4, an inner air path A and an outer air path B. The inner grill 2 is installed removably to the partition 4 and the frame 3 from the front side of the body 1 and provided with a suction inlet 5. The frame 3 formed of a resin is provided with an outer grill 6 which covers the outer air path B. The outer grill 6 has a louver 8 extending from the left side to the right side all through the back side thereof and a suction louver 9 projecting right upward from the top side thereof.

The reference numerals 10 and 11 denote a suction portion and an outlet portion formed by the louver 8, respectively. Inside the outer grill 6 are disposed longitudinal ribs 12 reinforcing the louver 8 at its outlet portion 11 and projecting to the inner side, a boss 14 to fix to the frame 3 an outer heat exchanger 13 constituting a known freezing cycle, bosses 15 to fix the partition 4 at the both ends and the center of the top face thereof and ribs to contact the top and bottom ends of side plates 16, 17 of the outer heat exchanger 13, respectively, to prevent noise which may raise when the side plates 16, 17 contact the outer grill 6.

A base plate 7 inserted in the inner grill 2 is entirely surrounded by a rib 20 whose height is made to be higher than the position of the bottom of the louver 8. On the front side of the rib 20 which also functions as a moisture-collecting pan is provided a hole 22 for fixing an inner heat exchanger 21 with a screw. On the base plate 7 is disposed a compressor 23 which constitutes a known freezing cycle. The outer air path B is built up by the outer heat exchanger 13 opposing the outlet portion 11, a propeller fan 24 having a slinger ring to blow air to radiate the heat generated from the outer heat exchanger 13 and to splash the water on the base plate 7 at the same time, a fan motor 25 fixed with a screw to the partition 4 to drive the propeller fan 24, an air guider 26, the compressor 23, pipings and other parts.

The inner air path A is built up by the inner heat exchanger 21 opposing the suction inlet 5 of the inner grill 2 and fitting at its bottom with the base plate 7, an air filter 27 interposed between the inner heat exchanger 21 and the suction inlet 5, a sirocco air guider 29 made of a heat-insulated foamed material which guides the condensed water formed by the inner heat exchanger 21 to the outer air path B and also functions as an air guider for a sirocco fan 28 set to the fan motor 25 to blow air to the inner heat exchanger 21, an outlet grill 30 including an operation panel 31, a suction hole 32 to suck in the air form the sirocco fan 28, a top cover 33 for the inner heat exchanger 21, an engaging piece 34 to fix the to of the side plate of the inner heat exchanger 21, a groove 36 to fix a thermo sensor 35, notches 37 to send air near the thermo sensor 35 to the sirocco fan 28 and claws 38 to engage with the partition 4, blades 39 to change the direction of the air blown out from the outlet grill 30, a power box 40 incorporating electric parts, a noise protection plate 41 to cover the part of the compressor 23 protruding to the inner portion beyond the partition 4, pipings and others.

Figure 5:
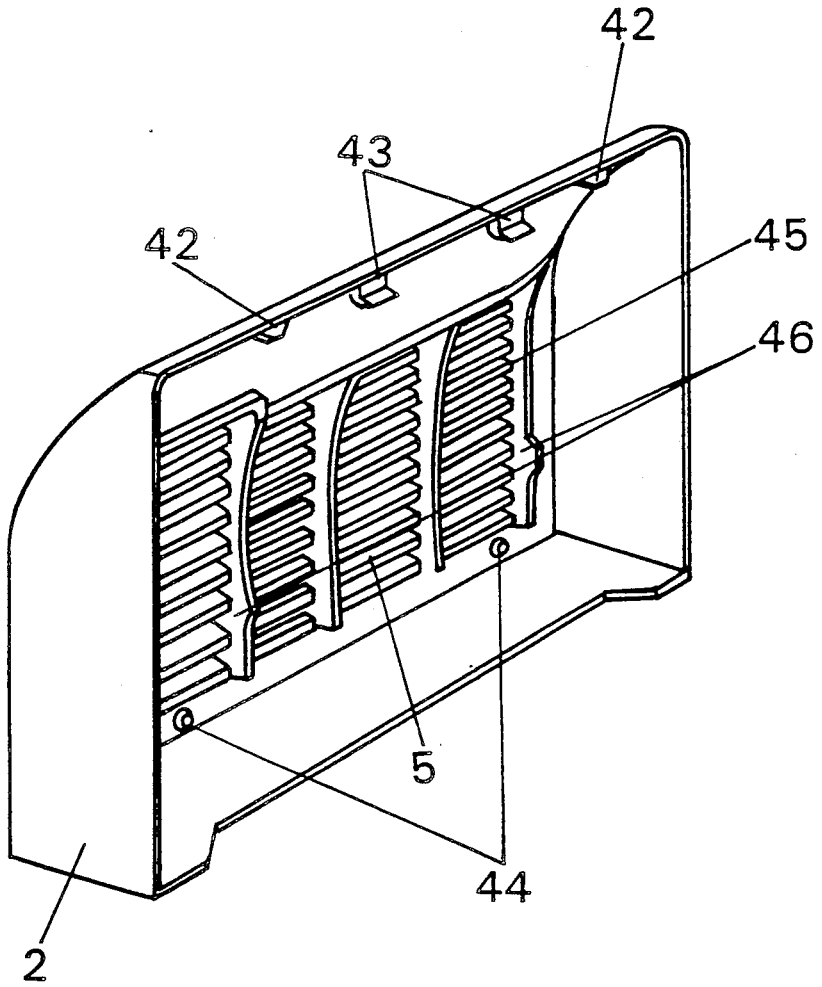
FIG. 5 is a perspective view of the inner grill of the self-contained air conditioner of FIG. 2.

Next, the methods to install the inner grill 2 and the air filter 27 and their structures are described. As shown in FIG. 5, the inner grill 2 is provided with claws 42 to engage with the partition 4, ribs 43 to reinforce the inner grill and holes 44 for screws, all of which are used to firmly install the inner grill 2 to the frame 3 and the partition 4.

In conventional air conditioners which are not provided with ribs for reinforcing the inner grill, claws are structurally weak and, as a result, in some cases, cracks or other troubles have been caused when the inner grill is installed to the frame 3 and the partition 4. For this reason, improvement in strength on this portion has been required. To solve this problem, the present invention provides ribs 43 for reinforcing in addition to the claws 42 to strengthen the inner grill 2.

In a second embodiment according to the present invention, the ribs 43 for reinforcing are formed to have a slant tip portion so as to function as a guide when the inner grill 2 is installed to the partition 4, thereby allowing smooth installation compared with conventional structures. This slant structure can also solve the post-installation problems such as a warp which have previously been caused depending on the method of installation or engagement performed. In the structure according to the present invention, the fitting portion of the partition 4 can be firmly supported by the slanted ribs and the claws 42 on the inner grill downward and upward.

In a third embodiment according to the present invention, a plurality of longitudinal ribs 45 are formed at the suction inlet 5 of the inner grill 2 to improve the strength of the inner grill 2. Further, a wave-shaped projection is formed in an integrated manner on the lower part of each of the two side longitudinal ribs 45. These projections function to interfere with spring-like projections 47 of the air filter 27, respectively, when the air filter 27 is placed to the inner grill 2, as a result, giving a feeling of complete fitting of the air filter and at the same time preventing the air filter from becoming dismounted.

In a fourth embodiment according to the present invention, the front part of the air filter 27 installed in the third embodiment described above is placed inside the position of the rib 20 surrounding the base plate 7 of the inner grill 2. The conventional air filter devised to be inserted into the inner grill by means of a rail is located in the position higher than the inner base plate. In such a structure, moisture formed on the air filter drops through the inner grill onto the floor of the room. Under the arrangement of this invention, the front part of the air filter placed inside the position of the base plate of the inner grill can prevent moisture formed on the air filter 27 from dropping onto floor of the room.

As evident from the above description, the present invention has characteristics and advantages as follows:

(1) The bottom of air filter is placed on the base plate of the inner grill, thereby preventing moisture formed on the air filter from dropping onto the floor of the room;

(2) Grill reinforcing ribs are provided on the back face of the inner grill to assist the elastic air filter to be easily installed in position on the back face of the inner grill. This arrangement also has the effect of preventing the vibration of the air filter and noise arising from this vibration;

(3) The base plate and the outer grill are formed by integrated resin molding, while the metal partition dividing the inner and outer portions is fixed on the base plate and ribs are formed on a fitting portion of the inner grill also formed by resin molding so as to firmly mount the inner grill to said partition. This arrangement of forming ribs on the inner grill helps reinforcement of the integratedly formed grill;

(4) The tip end of each rib formed on the inner grill is slanted so as to smoothly guide the inner grill to the partition when the inner grill is mounted to the partition. This arrangement ensures improvement of the installation.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A self-contained air conditioner comprising a base plate on which a compressor, an inner heat exchanger, and an outer heat exchanger are mounted, an inner grill positioned toward a room, an outer grill positioned toward the outside, and an elastic air filter resting on the base plate between said inner heat exchanger and said inner grill, the base plate being surrounded by a rim which constitutes a moisture-collecting pan, wherein the inner grill is provided with reinforcing ribs on the back face thereof so as to facilitate the insertion of the air filter and secure it to the inner grill.

2. A self-contained air conditioner according to claim 1, wherein grill reinforcing ribs are provided on the back face of the inner grill to assist the elastic air filter to be easily installed in position on the back face of the inner grill.

3. A self-contained air conditioner according to claim 1, wherein said base plate and said outer grill are formed by integrated resin molding, while a metal partition dividing the inner and outer portions is fixed on said base plate and ribs are formed on a fitting portion of the inner grill also formed by resin molding so as to firmly mount the inner grill to said partition.

4. A self-contained air conditioner according to claim 3, wherein the tip end of each rib formed on the inner grill is slanted so as to smoothly guide the inner grill to the partition when the inner grill is mounted to the partition.

* * * * *